United States Patent [19]

Le Masson

[11] 4,362,154

[45] Dec. 7, 1982

[54] PROCESSES AND DEVICES FOR REGULATING THE OXYGEN PARTIAL PRESSURE OF THE GAS MIXTURE OF THE RESPIRATORY CIRCUIT OF A DIVER

[75] Inventor: Yves Le Masson, Etampes, France

[73] Assignee: Laboratories de Mecaniques Appliquees "Lama", Etrechy, France; a part interest

[21] Appl. No.: 224,567

[22] PCT Filed: Mar. 21, 1980

[86] PCT No.: PCT/FR80/00042

§ 371 Date: Nov. 21, 1980

§ 102(e) Date: Nov. 17, 1980

[87] PCT Pub. No.: WO80/02016

PCT Pub. Date: Oct. 2, 1980

[30] Foreign Application Priority Data

Mar. 21, 1979 [FR] France ..... 79 07137
Oct. 5, 1979 [FR] France ..... 79 24850

[51] Int. Cl.[3] ..... B63C 11/20

[52] U.S. Cl. ..... 128/204.22; 128/201.27; 128/201.28; 128/205.26; 137/81.2; 137/487.5

[58] Field of Search ..... 128/205.26, 204.21, 128/204.22, 201.27, 201.28: 137/81.2, 487.5

[56] References Cited

U.S. PATENT DOCUMENTS

| | | | |
|---|---|---|---|
| 3,217,730 | 11/1965 | Banning, Jr. | 137/81.2 |
| 3,515,133 | 6/1970 | Parker | 128/201.27 |
| 3,524,444 | 8/1970 | Ellard | 128/201.27 |
| 3,593,735 | 9/1968 | Reiher | 137/88 |
| 3,688,770 | 9/1972 | O'Neill | 128/205.26 |
| 4,026,283 | 11/1975 | Banjavich | 128/142.3 |
| 4,195,628 | 4/1980 | Lubitzsch et al. | 128/201.27 |

FOREIGN PATENT DOCUMENTS 1572062 6/1969 France .

OTHER PUBLICATIONS

Mechanical Engineering, No. 12, vol. 97, Dec. 1975, P. S. Riegel, "Portable One-Man Recompression Chamber", pp. 26 to 31.

*Primary Examiner*—Henry J. Recla
*Attorney, Agent, or Firm*—Fleit & Jacobson

[57] ABSTRACT

Regulation of the oxygen partial pressure in the closed respiratory circuit of a diver. A sample of the gas mixture of the circuit is continuously taken and is passed into the monitor chamber (2) where its oxygen partial pressure is measured and an electrical control signal is generated if the measured pressure falls below a reference value. The signal is used to trigger an injection to the diver (4) of a defined amount of an oxygen-rich gas mixture. Application to dives in deep water.

21 Claims, 8 Drawing Figures

PROCESSES AND DEVICES FOR REGULATING THE OXYGEN PARTIAL PRESSURE OF THE GAS MIXTURE OF THE RESPIRATORY CIRCUIT OF A DIVER

The invention concerns regulating the oxygen partial pressure of the gas mixture in the respiratory circuit of a diver, the diver being provided with a closed-circuit respiratory apparatus connected to a remotely disposed monitor chamber in which there is a pressure which is equal to or close to atmospheric pressure.

It is applied in particular to the case of divers connected to a submarine of the 'diver-exiting' type, operating at a depth which can be down to 300 meters.

For divers to operate from a submarine, at great depth, it is necessary to use respiratory systems which have a low level of consumption as the amount of gas which can be stored on board submersible vessels is limited.

The respiratory systems of this type are 'closed circuit' systems in which the oxygen partial pressure is measured for controlling the intake of oxygen. The devices which are known at the present day are of compact nature. Accordingly, the conditions in regard to pressure and humidity require the electronic measuring device to be of such a degree of complexity and to have components of such a quality that such systems are burdensome and require particular competence and supervision on the part of the diver. Now, it is certain that the first function of the diver is to work effectively. It is penalising him to require him to have a preoccupation with his respiratory system when he is in a situation in regard to pressure which affects his reflexes and his initiative and capacity for decision.

The present invention seeks to liberate the diver from all respiratory preoccupations by arranging for that supervision task to be performed by the personnel adjacent the diver in the atmospheric observation chamber of the submarine.

According to the invention, this is achieved by means of a process wherein:

(a) a sample of the gaseous mixture in the respiratory circuit of the diver is continuously taken off, (b) said sample is passed into the monitoring chamber, the oxygen partial pressure of the sample is measured therein, and an electrical control signal is produced therein, if the measured pressure falls below a reference value, and (c) the control signal is used for triggering an injection of a defined amount of an oxygen-rich gas mixture to the respiratory circuit of the diver.

By transferring the entire measuring and regulating arrangement into the atmospheric chamber, not only does the electronic apparatus operate under standard conditions in respect of pressure and humidity, but the breathing apparatus carried by the diver is reduced to a simple and compact device.

In a typical example, the sample of the gas mixture is taken off at a flow rate which is in the range of from 0.2 to 0.6 normal liter per minute.

In a preferred embodiment, the sample from the respiratory circuit is passed to the monitor chamber by a capillary conduit in such a way that the variation in the oxygen partial pressure at the outlet of the capillary reproduces the variation at that pressure at the inlet of the capillary, and therefore in the respiratory circuit, with a delay, the section of the capillary being so selected as to limit the duration of the transfer of the sample along the capillary.

In a preferred embodiment, the interval between two injections is used to prepare said defined amount.

In a preferred embodiment, said defined amount is prepared by filling a container with the oxygen-rich mixture at a given differential pressure.

In a preferred embodiment, said injection is produced by discharging, into a simple conduit leading to the respiratory circuit, a container which had been previously filled with oxygen-rich mixture, at a given differential pressure.

The invention is not limited to this use.

Thus, the breathing apparatus used by the diver to provide him with the gas mixture which he is to breathe, instead of being carried by the diver, may be a chamber or tank in which the diver is located and in which there is an atmosphere which is breathed by the diver.

In one use, the breathing apparatus is a chamber in which the diver is disposed and which contains a gas mixture which is breathed by the diver.

In one case, that chamber is a hyperbar chamber disposed in a location forming the monitor chamber and intended to simulate the diving depth.

In another case, the chamber is a working tank submerged at the working depth.

In another use, the diver operates in the water from a submerged chamber forming a diving chamber connected to a monitoring chamber disposed on board a surface vessel, and the gas mixture is prepared in the submerged chamber.

Various uses will be described hereinafter with reference to the Figures of the accompanying drawings in which.

Figure 8:
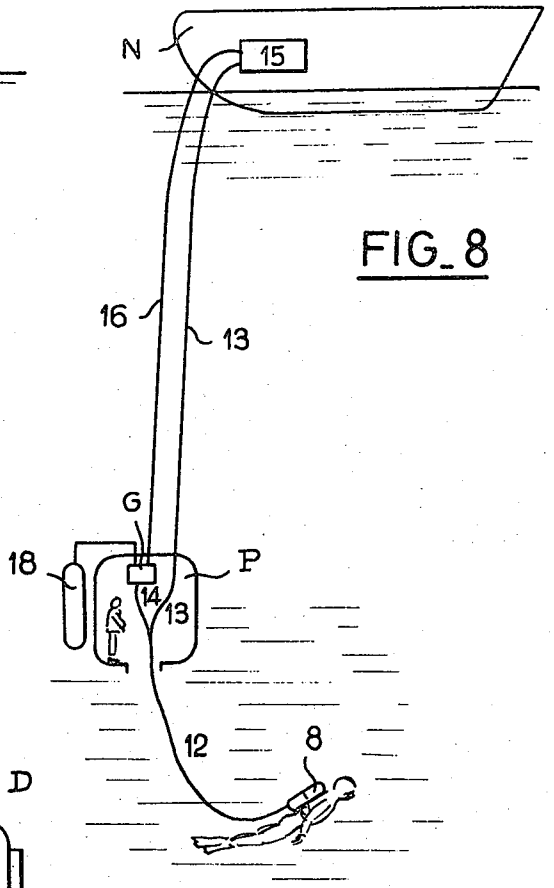
Figure 6:
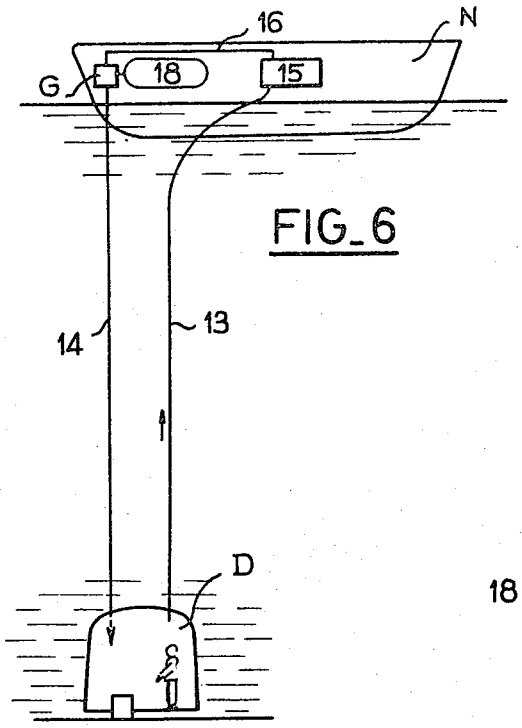
Figure 7:
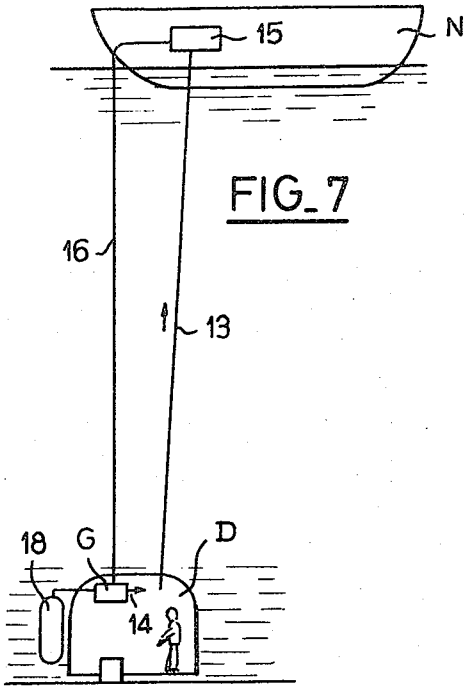
Figure 4:
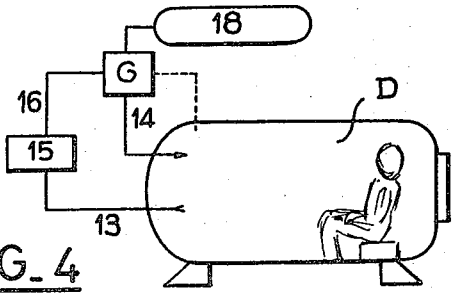
Figure 5:
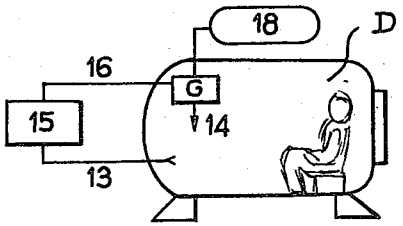

FIG. 4 is a diagrammatic view of a device according to the invention, in the case of a hyperbar chamber, FIG. 5 is an alternative form of the device of FIG. 4, FIG. 6 is a diagrammatic view of the device according to the invention, in the case of a working tank, FIG. 7 is an alternative form of the device of FIG. 6, and FIG. 8 is a diagrammatic view of a device according to the invention in the case of a diving bell.

Figure 1:
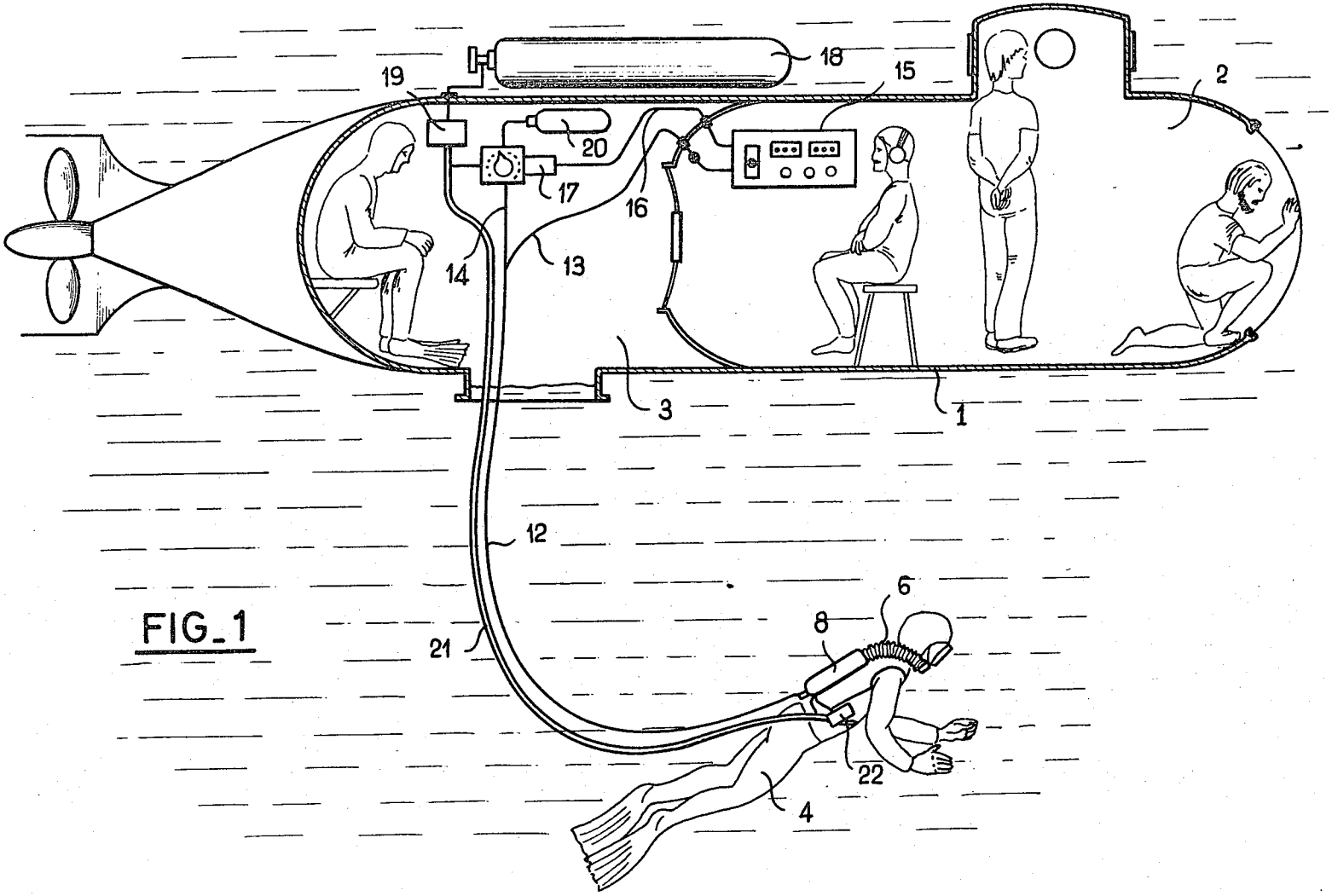
FIG. 1 is a general diagrammatic view of the device.

FIG. 1 shows a 'diver-exiting' submarine 1 which comprises a monitor chamber 2 in which the pressure is atmospheric and which contains the supervisory personnel, and a compartment 3 at the pressure of the bottom where the divers are diving. It is assumed that a diver 4 has left the compartment 3 and is operating in deep water, let us say at a depth of from 100 to 300 meters.

Figure 2:
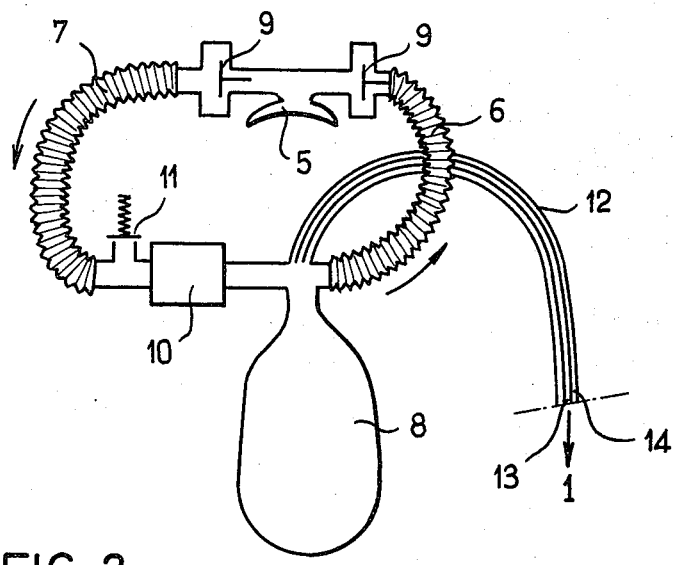
FIG. 2 is a diagrammatic view of the respiratory circuit of the diver.

The diver 4 is provided with a breathing device (FIGS. 1 and 2) which forms a closed respiratory circuit comprising a mask or mouthpiece 5 connected by two pipes 6 and 7 to a flexible bag 8 with a capacity of 4 to 5 liters. Non-return valves 9 ensure that the gases circulate in the direction indicated by the arrows, in per se known manner. The circuit includes a cartridge 10 for fixing the carbon dioxide which is breathed out, and a valve 11 for the discharge of an overflow of gas, if appropriate.

According to the invention, this circuit (for example in the region of the bag 8) is connected to the submarine by an umbilical 12 which contains two conduits 13 and 14 communicating with the interior of the circuit.

The circuit 13 is a capillary conduit of very small section (of the order of 0.5 mm in diameter) which connects the circuit to a measuring apparatus 15 in the monitor chamber 2 of the submarine.

The apparatus 15 continuously measures the oxygen partial pressure of the gas taken off by the capillary 13 and, in dependence on that measurement, supplies an electrical signal which, by way of a connection 16, controls a three-way electro-pneumatic distributor means 17 in the diving chamber.

Figure 3:
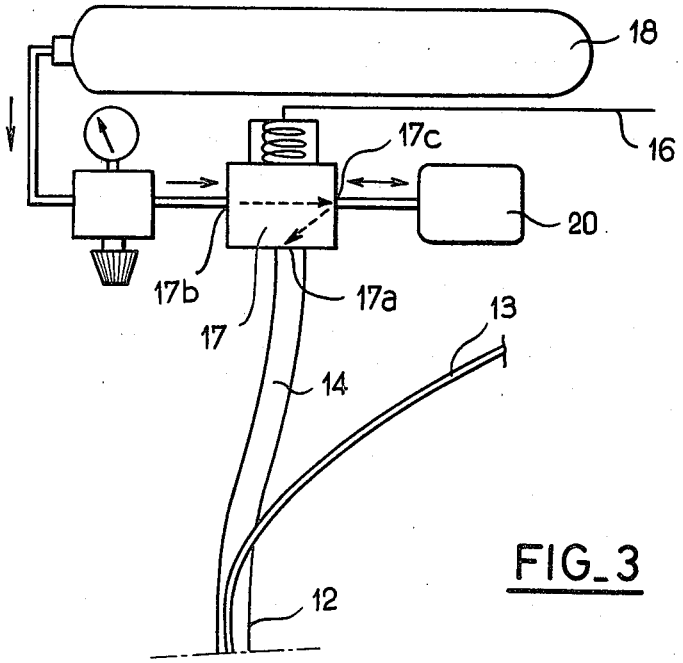
FIG. 3 is a diagrammatic view of a part of the device.

The electro-pneumatic distributor means 17 (FIGS. 1 and 3) has an output 17*a* to which the other conduit of the umbilical is connected, and comprises an inlet 17*b* connected to an external breathable gas tank 18 by way of a pressure-reducing valve 19 and another inlet 17*c* connected to a container 20 with a volume C, which is disposed for example in the diving compartment 3. The distributor means 17 communicates the container 20 either with the pressure reducing valve 19 or with the conduit 14.

In the rest condition of the distributor means, the container 20 is in communication with the pressure reducing valve and is charged to a stabilised differential pressure $\Delta p$. In operation of the distributor means, it is communicated with the conduit 14 into which it is discharged, supplying the diver with an amount C $\Delta p$ of breathable gas. The value of $\Delta p$ is pre-regulated and defined in dependence on the oxygen content of the gas mixture used.

Thus, in each discharge operation, the amount of oxygen supplied to the diver is perfectly defined. The respiratory circuit of the diver is closed between two injections.

The measuring device 15 is controlled to supply an electrical signal which controls the distributor means in order to discharge the container 20 into the conduit 14 as soon as the oxygen partial pressure detected is lower than a minimum reference value.

For example, according to the invention, the conditions are so set that, in each discharge, the oxygen partial pressure of the gas mixture which is breathed by the diver is raised by a constant value of 200 MB. The circuit of the diver is closed between two injections and the pressure fluctuates between the minimum reference value (for example 300 mb) and that value when increased by 200 mb (that is to say, 500 mb). The frequency of the injection operations depends on the work being done. At rest, it is about 1 injection every 2.5 minutes.

In order to eliminate any danger of hyperoxia, the oxygen content of the injected rich mixture is so selected that, at the working depth, the oxygen partial pressure of the injected mixture is close to 1000 mb. If required, the diver can then use that mixture freely by means of a direct feed connection 21 which connects the respiratory circuit of the diver to the pressure reducing valve 19, by means of a manual control 22; in particular, this manually controllable feed makes it possible if required to adjust the current respiratory volume.

The 'oxygen-rich' gas mixture is a mixture which is richer than the reference value. In the limit condition, the mixture may be pure oxygen.

The device is most suitable for diving depths of from 20 to 300 meters, the capillary providing an insufficient flow at a depth of less than 20 meters and an excessive response time at a depth of more than 300 meters.

In the embodiments shown in FIGS. 4 to 7, the device comprises:

a chamber D with diver therein;

a capillary gas conduit 13 between the chamber D and a device 15 for measuring the oxygen partial pressure, such device being disposed in a monitor chamber in which the pressure is close to atmospheric pressure, the device 15 being capable of measuring the oxygen partial pressure of the gas mixture in the chamber in which the diver is located and supplying a control signal when that pressure falls below a reference value;

a gas supply conduit 14 which opens into the chamber containing the diver; and means G for preparing a defined amount of an oxygen-rich gas and injecting said amount into said supply conduit under the control of the control signal.

The means G represent the assembly of the means 17 (distributor means), 19 (pressure reducing valve) and 20 (container) of the device of FIG. 1, or equivalent means.

In the embodiment of FIG. 4, the chamber D is a hyperbar chamber and the means G are outside the chamber, the exterior of the chamber forming the monitor chamber.

Preferably, the pressure reducing valve 19 is pilot-controlled by the pressure within the chamber D, the pilot-controlled connection being shown by the broken line connection shown in the drawing.

In the embodiment of FIG. 5, the means G are disposed within the hyperbar chamber D (decompression tank or saturation chamber).

In the embodiment of FIGS. 6 and 7, the chamber D forms a working tank which is positioned directly on the site of operations and the diver operates therein in a dry condition, without a breathing mask, so that he directly breathes the atmosphere in the chamber.

In the embodiment of FIG. 6, the pneumatic system is disposed in a monitor chamber forming part of a surface vessel N. The chamber is connected to the working tank by the capillary conduit 13 which connects to the measuring device 15 and by the supply conduit 14 which connects the interior of the working tank to the pneumatic system G.

In the embodiment of FIG. 7, the pneumatic system G is disposed in the tank itself and the monitor chamber only contains the measuring device 15.

In the embodiment of FIG. 8, the device comprises:

a closed circuit respiratory device 8 worn by the diver;

a monitor chamber which is disposed on board a surface vessel N and in which there is a pressure close to atmospheric pressure;

a capillary gas conduit 13 between said circuit and a device 15 for measuring the oxygen partial pressure, which is disposed in the monitor chamber and which is capable of measuring the oxygen partial pressure of the gas mixture in the circuit and supplying a control signal when that pressure falls below a reference value; and a submerged diver chamber P provided with means G for preparing a defined amount of an oxygen-rich gas and injecting said amount of gas into a gas supply conduit 12 connecting the diver chamber to the respiratory circuit of the diver, under the control of the control signal.

I claim:

1. A process for regulating the oxygen partial pressure of a gas mixture in a respiratory circuit of a diver, the diver being provided with a closed circuit breathing apparatus connected to a remotely located monitor chamber in which there is a pressure equal to or close to atmospheric pressure, said process comprising:

(a) continuously removing a sample of the gas mixture of the respiratory circuit of the diver;

(b) passing said sample into the monitor chamber where it expands, the partial oxygen pressure of the sample being determined therein, and an electrical control signal being produced when the pressure determined falls below a reference value; and (c) using the control signal for triggering an injection of a defined and preset amount of an oxygen-rich gas mixture to the respiratory circuit of the diver, the sample from the respiratory circuit being passed to the monitor chamber by a capillary conduit so that the variation in the oxygen partial pressure at the outlet from the capillary conduit reproduces the variation in the pressure at the inlet of the capillary conduit and, therefore, in the respiratory circuit, with a delay, the section of the capillary conduit being so selected as to limit the duration of the transfer of the sample along the capillary conduit.

2. A process according to claim 1, characterised in that the interval between two injections is used to prepare said defined and preset amount.

3. A process according to claim 1, characterised in that said defined and preset amount is prepared by charging a container with the oxygen-rich mixture at a given differential pressure.

4. A process according to claim 1, characterised in that said injection is effected by discharging, into a conduit leading to the respiratory circuit, a container which has been previously filled with the oyxgen-rich mixture, at a given differential pressure.

5. A process according to claim 1, characterised in that the respiratory circuit of the diver is maintained in a closed condition between two injections.

6. A process according to claim 1, characterised in that the breathing apparatus of the diver comprises a chamber in which the diver is disposed and which contains a gas mixture which is breathed by the diver.

7. A process according to claim 1, characterised in that said chamber is a working tank which is submerged at the working depth.

8. A process according to claim 1, wherein said monitor chamber is provided in a submarine positioned close to a working depth of the diver.

9. A process for regulating the oxygen partial pressure of a gas mixture in a respiratory circuit of a diver, the diver being provided with a closed circuit breathing apparatus connected to a remotely located monitor chamber in which there is a pressure equal to or close to atmospheric pressure, the breathing apparatus of the diver comprising a chamber in which the diver is disposed and which contains a gas mixture which is breathed by the diver, said chamber being a hyperbar chamber disposed in a location forming the monitor chamber and intended to simulate the diving depth, said process comprising:

(a) continuously removing a sample of the gas mixture of the respiratory circuit of the diver;

(b) passing said sample into the monitor chamber where it expands, the partial oxygen pressure of the sample being determined therein, and an electrical control signal being produced when the pressure determined falls below a reference value; and (c) using the control signal for triggering an injection of a defined and preset amount of an oxygen-rich gas mixture to the respiratory circuit of the diver.

10. A process according to claim 9, characterised in that said injection is effected by discharging, into a simple conduit leading to the hyperbar chamber, a container which has been previously filled with the oxygen-rich mixture, at a given differential pressure.

11. A process according to claim 10, characterised in that said container is filled from a source of said oxygen-rich gas mixture by way of a pressure reducing valve which is pilot-controlled by the pressure in the hyperbar chamber.

12. A process for regulating the oxygen partial pressure of a gas mixture in a respiratory circuit of a diver, the diver being provided with a closed circuit breathing apparatus connected to a remotely located monitor chamber in which there is a pressure equal to or close to atmospheric pressure, said gas mixture being prepared in a submerged chamber forming a diving chamber connected to the monitor chamber which is disposed on board a surface vessel, said process comprising:

(a) continuously removing a sample of the gas mixture of the respiratory circuit of the diver;

(b) passing said sample into the monitor chamber where it expands, the partial oxygen pressure of the sample being determined therein, and an electrical control signal being produced when the pressure determined falls below a reference value; and (c) using the control signal for triggering an injection of a defined and preset amount of an oxygen-rich gas mixture to the respiratory circuit of the diver.

13. A device for regulating the oxygen partial pressure of a gas mixture in a respiratory circuit of a diver, the diver being provided with a closed circuit breathing apparatus connected to a submarine having a monitor chamber provided therein maintained at a pressure close to atmospheric pressure, said device comprising:

a closed circuit respiratory device carried by a diver;

means in the monitor chamber for measuring the oxygen partial pressure of the gas mixture of the respiratory circuit and for supplying a control signal when said pressure falls belows a reference value;

a capillary gas conduit extending between said respiratory device and said means for measuring;

means carried by the submarine for preparing a defined amount of an oxygen-rich gas;

a gas supply conduit connecting the respiratory device to the submarine; and means associated with the means for measuring for injecting said defined amount into said supply conduit under the control of said control signal.

14. A device according to claim 13, wherein said means for preparing comprises a pneumatic device, an oxygen-rich breathable gas reserve, and a container, said pneumatic device being connected to said gas reserve, said container, and said supply conduit and being controlled by the means for measuring for establishing a communication either between the reserve and the container for charging the latter or between the container and said supply conduit for discharging the container into the supply conduit.

15. A device according to claim 14, characterised in that the pneumatic device is disposed in a compartment of the submarine which forms a diving chamber maintained at ambient pressure.

16. A device for regulating the oxygen partial pressure of a gas mixture in a chamber containing a diver, the diver breathing the gas mixture when the chamber is submerged, said apparatus comprising:

a first chamber for containing a diver;

a monitor chamber spaced from said first chamber having a pressure equal to or close to atmospheric pressure maintained therein;

means disposed in said monitor chamber for measuring the oxygen partial pressure of the gas mixture in said first chamber and for supplying a control signal when the measured partial pressure falls below a reference value;

a capillary gas conduit for interconnecting said first chamber and said means for measuring;

a gas supply conduit which opens into said first chamber containing the diver; and means for preparing a defined amount of an oxygen-rich gas and for injecting said amount into said supply conduit under the control of said control signal.

17. A device according to claim 16, characterised in that said first chamber containing the diver is a hyperbar chamber.

18. A device according to claim 16, characterised in that said first chamber containing the diver is a working tank which is submerged at the working depth.

19. A device for regulating the oxygen partial pressure of a gas mixture in a respiratory circuit of a diver, said gas mixture being prepared in a submerged chamber forming a diving chamber connected to a monitor chamber disposed on board a surface vessel, said device comprising:

a closed circuit breathing device worn by the diver and containing the respiratory circuit;

a monitor chamber disposed on board a surface vessel and in which the pressure is close to atmospheric pressure;

means disposed in the monitor chamber for measuring the oxygen partial pressure of the gas mixture of said breathing device and for supplying a control signal when said pressure falls belows a reference value;

a capillary gas conduit connecting said breathing device and said means for measuring;

a submerged diver chamber connected to said monitor chamber; and a gas supply conduit connecting said diver chamber and said breathing device, said diver chamber being provided with means for preparing a defined amount of an oxygen-rich gas and for injecting said defined amount into the gas supply conduit under the control of said control signal.

20. A device for regulating the oxygen partial pressure of a respiratory circuit of a diver comprising:

a submarine having a monitor chamber formed therein maintained at a pressure close to atmospheric pressure;

a respiratory circuit for supplying a gas mixture to a diver, the respiratory circuit being carried by the diver and including means for removing carbon dioxide from the gas mixture and means for storing the gas mixture;

a capillary gas conduit connecting said respiratory circuit and said monitor chamber;

means connected to said capillary gas conduit disposed in said monitor chamber for measuring the oxygen partial pressure of the gas mixture in the respiratory circuit and for supplying a control signal when the measured partial pressure falls below a reference value;

gas supply means carried by said submarine for preparing a defined amount of an oxygen-rich gas;

a gas supply conduit connecting said gas supply means and said respiratory circuit; and means responsive to said control signal for injecting said defined amount of the oxygen-rich gas into the gas supply conduit.

21. A device according to claim 20, wherein said gas supply means comprises a tank for storing the oxygen-rich gas, and a container for holding said defined amount; said means for injecting comprising valve means having an inlet connected to said tank, a first outlet connected to said container, and a second outlet connected to said gas supply conduit, said valve means being movable between a first position interconnecting said tank and said container, and a second position interconnecting said container and said gas supply conduit.

* * * * *